US005289810A

United States Patent [19]

Bauer et al.

[11] Patent Number: 5,289,810

[45] Date of Patent: Mar. 1, 1994

[54] ARRANGEMENT FOR SUPPLYING FUEL FROM SUPPLY TANK TO INTERNAL COMBUSTION ENGINE OF MOTOR VEHICLE

[75] Inventors: Otto Bauer; Gerhard Geyer, both of Munich, Fed. Rep. of Germany

[73] Assignee: Robert Bosch GmbH, Stuttgart, Fed. Rep. of Germany

[21] Appl. No.: 63,992

[22] Filed: May 19, 1993

[30] Foreign Application Priority Data

Jul. 29, 1992 [DE] Fed. Rep. of Germany ..... 4224981

[51] Int. Cl.[5] ..... F02M 37/10

[52] U.S. Cl. ..... 123/510; 137/563; 137/576; 123/514

[58] Field of Search ..... 123/497, 509, 510, 514, 123/456; 137/571, 574, 576, 563

[56] References Cited

U.S. PATENT DOCUMENTS

| | | | |
|---|---|---|---|
| 4,279,232 | 7/1981 | Schuster et al. | 123/514 |
| 4,911,134 | 3/1990 | Olsson | 123/509 |
| 5,070,849 | 12/1991 | Rich et al. | 123/509 |
| 5,133,324 | 7/1992 | Michiaki | 123/514 |
| 5,139,000 | 8/1992 | Sawert | 123/514 |
| 5,148,792 | 9/1992 | Tuckey | 123/497 |
| 5,218,942 | 6/1993 | Coha et al. | 123/509 |

*Primary Examiner*—Tony M. Argenbright
*Assistant Examiner*—Thomas N. Moulis
*Attorney, Agent, or Firm*—Michael J. Striker

[57] ABSTRACT

An arrangement for supplying fuel from a supply container to an internal combustion engine of a motor vehicle, has a supply tank having an interior with a separate chamber, a supply aggregate having a suction side connected with the supply tank and a pressure side connectable with the internal combustion engine, the supply aggregate receiving fuel from the separate chamber of the supply tank, a branching conduit connected with the pressure side of the supply aggregate and having a portion extending near a bottom of the supply tank, an ejector arranged in the portion of the branching conduit and having a pressure pipe opening in the chamber of the supply tank, and a check valve provided in the branching conduit upstream of the ejector as considered in a flow direction of fuel, and opening in the branching conduit after a predetermined limiting pressure has been exceeded.

9 Claims, 1 Drawing Sheet

ARRANGEMENT FOR SUPPLYING FUEL FROM SUPPLY TANK TO INTERNAL COMBUSTION ENGINE OF MOTOR VEHICLE

BACKGROUND OF THE INVENTION

The present invention relates to an arrangement for supplying fuel from a supply tank to an internal combustion engine of a motor vehicle.

More particularly, it relates to an arrangement of the above mentioned type which has a supply aggregate connected at a suction side with a supply tank and at a pressure side with an internal combustion engine, and also branching conduits with a portion accommodating an ejector.

Supply arrangements of the above mentioned general type are known in the art. In the known arrangement the ejector is used for sufficient filling of a supply cup in which the supplying aggregate is arranged and for supplying the fuel from it to the internal combustion engine. Thereby even with a relatively empty fuel tank of the supply aggregate a fuel supply is provided, which guarantees that long increases can be overcome without problems. A further objective which can be solved with an .ejector is that the fuel contained in a two-chamber supply tank is available and is supplied by the ejector into the chamber from which the supply aggregate aspirates the fuel.

However, during starts of the internal combustion engine when only a relatively low voltage is provided in the drive motor of the supply aggregate and thereby a substantially reduced supply power of the aggregate takes place, a certain fuel quantity flows through the ejector in dependence on the nozzle diameter without producing in the gasoline injection system a pressure which is sufficient for the start. With low feed flow consumption and high system pressure a relatively small feed nozzle diameter is required. It however must be produced with narrow tolerances and is prone to dirtying in these conditions. The feed nozzle diameter can b made greater than approximately 0.4 mm. However, the above mentioned disadvantages during starts of the internal combustion engine are especially pronounced.

The required feed flow for a predetermined suction flow consumption corresponding generally to at least the maximum motor consumption, is substantially inversely proportional to the feeding pressure. With the advantageous branching at the pressure side of the supply system the feed pressure is substantially identical to the system pressure of the injection device of the internal combustion engine.

SUMMARY OF THE INVENTION

Accordingly, it is an object of the present invention to provide an arrangement for supplying fuel from a supply tank to an internal combustion engine of a motor vehicle, which avoids the disadvantages of the prior art.

In keeping with these objects and with others which will become apparent hereinafter, one feature of the present invention resides, briefly stated, in an arrangement for supplying fuel from a supply tank to an internal combustion engine, in which a check valve is provided in the branching conduit before the ejector as considered in the flow direction of fuel and the check valve opens the branching conduit upon exceeding a predetermined limiting pressure.

When the arrangement is designed in accordance with the present invention, the check valve opens the branching conduit to the ejector after reaching a limiting pressure and thereby the disturbing deviation of a fuel volume flow through the feed nozzle of the ejector and therefore the resulting delay of the pressure increase in the injecting system during the starting phase of the internal combustion engine is avoided. In addition, the action of the ejector after opening of the check valve is produced to a full extent since then the feeding pressure for which it is provided becomes available.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
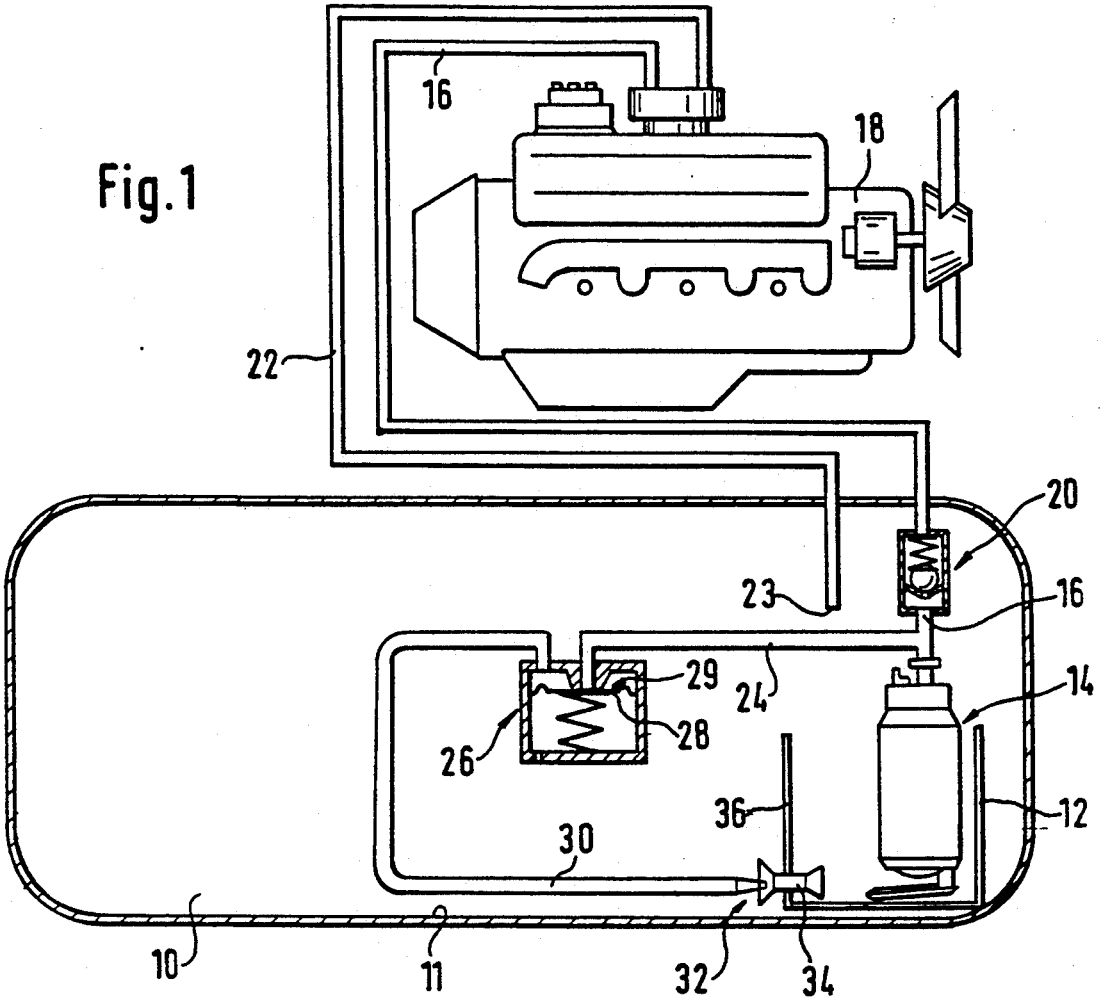
FIG. 1 is a view schematically showing a supplying arrangement in which a branching conduit after a supply aggregate is closed and provided with a mechanically operating check valve.

An arrangement for supplying fuel shown in FIG. 1 has a supply tank 10 with a separate container-like chamber 12 in its interior. The separate chamber 12 is cup-shaped. A supply aggregate 14 is arranged in the cup 12 and includes an electric motor and a pump part accommodated in a joint housing. The supply aggregate 14 aspirates fuel from the cup 12 and pumps it through a supply conduit 16 to an internal combustion engine 18 of a not shown motor vehicle. A non-return valve 20 is arranged in the supply conduit 16. Since the supply conduit 14 has available fuel for the internal combustion engine in greater quantity than consumed, a return conduit 22 returns the excessive fuel back into the tank 10. The opening 23 of the return conduit 22 is arranged so that the fuel which flows back is supplied to the supply cup 12. In the example shown in FIG. 1, a branching conduit 24 is connected with the supply conduit 16 and in particular before the check valve 20 as considered in the flow direction of the fuel. A check valve 26 is arranged in the branching conduit 24. The check valve 26 is formed in this embodiment as a diaphragm valve with a closing member arranged on a diaphragm 28 and spring loaded toward a closing position. It cooperates with a valve seat 29 which surrounds the opening of the branching conduit 24. The branching conduit 24 has a portion 30 which extends near a bottom 11 of the tank. An ejector (jet pump) 32 is arranged in the portion 30. The ejector in this embodiment is arranged in a lying position and a pressure tube 34 of the ejector extends through a chamber wall 36 so as to open in the chamber 12. In the branching conduit 24 the arrangement of the check valve 26 is formed so that it is located before the jet pump 32 as considered in the flow direction of the fuel.

When the fuel supply aggregate 14 is started together with the internal combustion engine 18, fuel is supplied through the supply conduit 16 to the internal combustion engine. Simultaneously a pressure builds up a first portion of the branching conduit 24, which is made possible and maintained by the closed check valve 26. When a predetermined limiting pressure is reached, the whole volume flow supplied by the supply aggregate is pumped into the injection system of the internal combustion engine and thereby a fast pressure build up is guaranteed. When this pressure exceeds a predetermined limiting pressure in the branching conduit 24, the check valve 26 opens and the fuel can flow through the portion 30 to the jet pump 32 which then operates with maximum effect.

Figure 2:
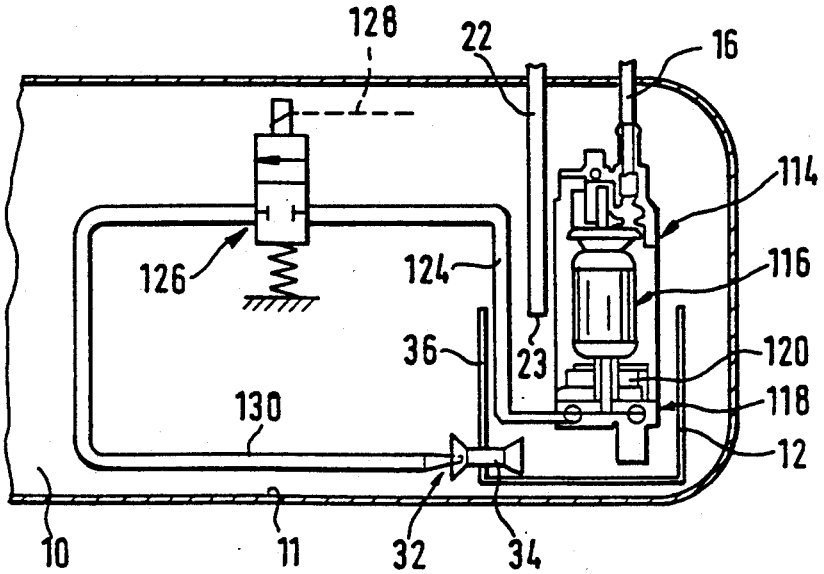
FIG. 2 is a view schematically showing of a part of a differently formed supplying arrangement with a supply aggregate having two pump stages and an electromagnetically actuating check valve.

In the embodiment shown in FIG. 2 the parts which correspond to the parts of the embodiment of FIG. 1 are identified with the same reference numerals. In deviation from the embodiment of FIG. 1, the fuel supply aggregate 114 is formed as two-stage aggregate as can be seen in section of FIG. 2. In addition to the electrical drive motor 116, the fuel supply aggregate 114 has a flow pump 118 which operates as a pre-supply pump. The pre-supply pump 118 supplies the fuel to a second supply stage which can be identified as a pump stage 120. From the pump stage 120 the fuel is pumped by the electric drive motor 116 to the supply conduit 16. In this embodiment also a return conduit 22 is provided, and its opening 23 is oriented to the separate cup 12. In deviation from the embodiment of FIG. 1, the branching conduit 125 is connected with the supply system directly behind the pre-supply stage 118. From there a partial stream of fuel flows to the portion 130 of the branching conduit which extends near the bottom 11 of the tank. Also in this embodiment a ejector 32 is formed on the portion 130 and its pump tube 34 extends through the cup wall 36 of the chamber 10 so that the ejector 32 contributes to filling of the cap 12. In deviation from the embodiment of FIG. 1, the check valve 126 is formed as an electromagnetically operating 2/2 valve. The valve 126 is formed so that in its stationary position shown in FIG. 2 it blocks the branching conduit 124. The actuation of the electromagnetic check valve 126 can be performed in a time-dependent manner so as to depend from starts of the supply aggregate 114 and/or in dependence on the pressure building up in the branching conduit 124.

After reaching the criterium required for the actuation of the check valve 126, a pulse is supplied through a control conductor 128, and the check valve 126 is transferred to its another operative position. The branching conduit 124 is released, so that the fuel under pressure in the branching conduit 124 is pumped in the guiding portion 130 and the ejector 32 operates with full efficiency.

The arrangement of FIG. 1 can be designed also with an electrically controlled check valve analogous to FIG. 2. The arrangement of FIG. 2 can be provided with a mechanically operating valve instead of the electrically operating valve.

The diaphragm valve shown in FIG. 1 can be replaced by another mechanically operating valve. At the same time it is simple and robust in construction and reliable in operation. The electromagnetic valve 126 in accordance with the embodiment of FIG. 2 in addition to the above described operation also provides for a desired reduction of the feed pressure due to cyclical control of the magnetic valve.

In both embodiments the common feature is that a check valve 26 or 126 is arranged in the branching conduit 24 or 124 before the ejector (jet pump) 32 as considered in the flow direction of fuel, and the check valve opens in the branching conduit after exceeding a predetermined limiting value.

It will be understood that each of the elements described above, or two or more together, may also find a useful application in other types of constructions differing from the types described above.

While the invention has been illustrated and described as embodied in an arrangement for supplying fuel from supply tank to internal combustion engine of motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for supplying fuel from a supply container to an internal combustion engine of a motor vehicle, comprising a supply tank having an interior with a separate chamber; a supply aggregate having a suction side connected with said supply tank and a pressure side connectable with the internal combustion engine, said supply aggregate receiving fuel from said separate chamber of said supply tank; a branching conduit connected with said pressure side of said supply aggregate and having a portion extending near a bottom of said supply tank; an ejector arranged in said portion of said branching conduit and having a pressure pipe opening in said chamber of said supply tank; and a check valve provided in said branching conduit upstream of said ejector as considered in a flow direction of fuel, said check valve opening in said branching conduit after a predetermined limiting pressure has been exceeded.

2. An arrangement as defined in claim 1, wherein said chamber is formed as a cup-shaped container which is fixedly connected with said supply tank, said suction side of said supply aggregate immersing in said container.

3. An arrangement as defined in claim 1, wherein said check valve has a spring loaded closing member and a valve seat with which said closing member cooperates, said branching conduit having an opening which is surrounded by said valve seat.

4. An arrangement as defined in claim 1, wherein said check valve is formed as an electromagnetically operating 2/2 valve.

5. An arrangement as defined in claim 4, wherein said electromagnetically operating valve is closed in condition of no current.

6. An arrangement as defined in claim 2, wherein said check valve s formed as an electromagnetically operating 2/2 valve.

7. An arrangement as defined in claim 6, wherein said electromagnetically operating valve is closed in condition of no current.

8. An arrangement as defined in claim 1; and further comprising a pre-supply conduit for the internal combustion engine, said supply aggregate having an output, said branching conduit being connected with said pre-supply conduit downstream of said output of said supply aggregate as considered in a flow direction of fuel.

9. An arrangement as defined in claim 1, wherein said supply aggregate includes a plurality of pump stages arranged in a series, said branching conduit being connected between two neighboring ones of said pump stages at said pressure side of said supply aggregate.

* * * * *